US005318094A

United States Patent [19]

Joy et al.

[11] Patent Number: 5,318,094

[45] Date of Patent: Jun. 7, 1994

[54] PRODUCTION OF COMPLEX CAVITIES INSIDE CASTINGS OR SEMI-SOLID FORMS

[75] Inventors: Theodore J. Joy, Mishawaka, Ind.; David M. McCray, Tipp City, Ohio

[73] Assignee: Allied-Signal Inc., Morristown, N.J.

[21] Appl. No.: 951,359

[22] Filed: Sep. 25, 1992

Related U.S. Application Data

[63] Continuation of Ser. No. 587,814, Sep. 25, 1990, abandoned.

[51] Int. Cl.[5] ..... B22C 9/04; B22D 19/16

[52] U.S. Cl. ..... 164/98; 164/34; 164/76.1; 164/45

[58] Field of Search ..... 164/98, 45, 14, 8, 99, 164/100, 76.1, 34

[56] References Cited

U.S. PATENT DOCUMENTS

| | | | |
|---|---|---|---|
| 1,416,412 | 5/1922 | Pack . | |
| 1,491,817 | 4/1924 | Pack . | |
| 1,710,534 | 4/1929 | Field . | |
| 1,897,663 | 2/1933 | Gordon . | |
| 2,362,875 | 11/1944 | Zahn | 22/200 |
| 2,362,876 | 11/1944 | Balassa | 106/172 |
| 2,368,296 | 1/1945 | Goran | 22/203 |
| 2,609,576 | 9/1952 | Roush et al. | 22/200 |
| 2,682,692 | 7/1954 | Kohl | 22/193 |
| 2,812,562 | 11/1957 | Dalton | 22/200 |
| 2,890,318 | 6/1959 | Kruse | 164/98 |
| 2,963,757 | 12/1960 | Hawkins et al. | 22/167 |
| 3,591,755 | 7/1971 | Cushman | 164/80 |
| 3,805,874 | 4/1974 | Wahlqvist | 164/132 |
| 3,991,811 | 11/1976 | Diez et al. | 164/121 |
| 4,532,974 | 8/1985 | Mills et al. | 164/132 |
| 4,637,449 | 1/1987 | Mills et al. | 164/132 |
| 4,712,605 | 12/1987 | Sasaki | 164/98 |
| 4,905,750 | 3/1990 | Wolf | 164/35 |

FOREIGN PATENT DOCUMENTS

| | | | |
|---|---|---|---|
| 435917 | 10/1926 | Fed. Rep. of Germany . | |
| 817492 | 10/1951 | Fed. Rep. of Germany . | |
| 2648729 | 5/1978 | Fed. Rep. of Germany . | |
| 1243333 | 8/1960 | France . | |
| 54-44650 | 12/1979 | Japan | 164/97 |
| 62-168657 | 7/1987 | Japan | 164/76.1 |

OTHER PUBLICATIONS

Design-Effective Production-Prove Leachable Core Technology Ross Aluminum Foundaries Advertising Brochure dated Jul. 7, 1978.

*Primary Examiner*—Paula A. Bradley
*Assistant Examiner*—Rex E. Pelto
*Attorney, Agent, or Firm*—Larry J. Palguta; Ken C. Decker

[57] ABSTRACT

The production of complex cavities inside castings or semi solid forms is effected by forming a core pattern (10) of a low melting point metal in order to provide a rigid metal core pattern (10). The pattern (10) is then nickel coated using either electroplating or electroless nickel plating. The metal core pattern (10) is melted out of the nickel plating to provide a nickel liner core (16). The nickel liner core (16) is placed within a mold or die cavity, and molten metal introduced into the cavity in order to provide a casting or form (30). The casting or form (30) is removed from the cavity and includes therein a plurality of passageways (20) each of which is defined and surrounded by a corrosion resistent nickel liner surface (22).

9 Claims, 2 Drawing Sheets

PRODUCTION OF COMPLEX CAVITIES INSIDE CASTINGS OR SEMI-SOLID FORMS

This is a Continuation of abandoned application Ser. No. 07/587,814 filed Sep. 25, 1990, abandoned.

The present invention applies generally to a metal casting process, and in particular to a metal casting process for providing intricate interconnecting smooth, clean passageways inside a castable metal.

Die, squeeze, sand, lost foam, permanent mold, or semi-solid casting and forming technology has not yet found a way to provide small, intricate diameter smooth holes within a casting. A number of prior art and state-of-the-art processes can provide small passageways, but have inherent drawbacks and sometimes fail to provide clean, smooth passageways which are highly desirable if the passageways will convey fluids, in particular a hydraulic fluid. There is presently no known method to produce such small diameter smooth and complicated passageways using a high volume casting process. The machining or drilling of communication holes within a casted metal body requires that the communication holes be straight and terminate at an outside surface. This often requires a large number of holes and plugs to produce desired connections. As in any drilling operation, the risk and cost of broken drills is always present. Sand cores tend to be very fragile and frequently get broken or distorted before or during the casting or forming process. The removal of sand, particularly in complicated cores after casting or forming, is difficult to control. The resulting rough surface is undesirable for efficient and clean fluid transmission. Leachable core technology provides cores which are quite fragile and which limits the complexity achievable for high volume production U.S. Pat. No. 4,532,974 discloses a leachable core process wherein the core is removed by leaching after casting and forming, and this makes the process unsuitable for high volume production. Fabricated metal tubing assemblies may be placed into a mold or die prior to casting or forming. The fabrication of accurate tubing assemblies is costly and difficult to control. Any brazed or welded connections can contribute to leaks or metallurgical contamination. Coring is generally limited to constant diameter cross-sections.

It is highly desirable to provide a means for producing circuitous communication holes in a metal body suitable for accommodating high pressure fluid or gas as part of a casting or semi-solid forming process. The mechanism provided should not be subject to the usual restrictions inherent to drilling, removable sand cores, or other state-of-the-art processes. It is also an object of the present invention to provide a means for producing complex cavities inside castings or semi-solid forms, in particular an anti-lock brake modulator which provides transmission routes for hydraulic fluid. The complex cavities or passageways should be smooth and corrosion resistent. It is desirable to reduce the cost of existing modulator/manifold designs by producing holes during the casting or forming process in order to eliminate extensive and costly drilling and plugging.

The present invention provides solutions to the above problems by providing a process for producing a form having smooth, clean passageways inside the form, comprising the steps of:

a. forming a core pattern from a low melting point material in order to provide a rigid core pattern, b. coating the pattern with nickel, c. heating the pattern to melt the pattern away from the nickel coating in order to provide a nickel liner core defining passageways therein, d. placing the nickel liner core within a cavity, e. introducing one of a molten material and a formable material within said cavity and about said liner core in order to provide said form, and f. removing the form from said cavity whereby the liner core comprises a corrosion resistent liner about said passageways within said form.

The present invention is described in detail below with references to the drawings which illustrate a process wherein.

Figure 1:
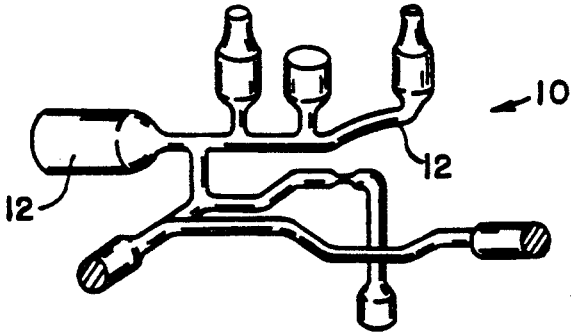
FIG. 1 is an illustration of the core pattern made of a low melting point metal.
Figure 2:
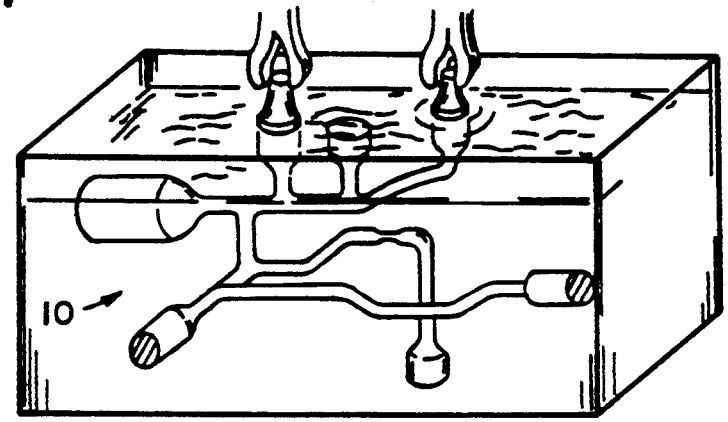
FIG. 2 is an illustration of the coating of the pattern.
Figure 3:
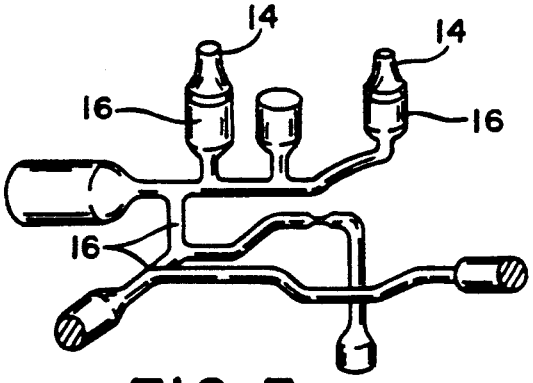
FIG. 3 is an illustration of the coated pattern.
Figure 4:
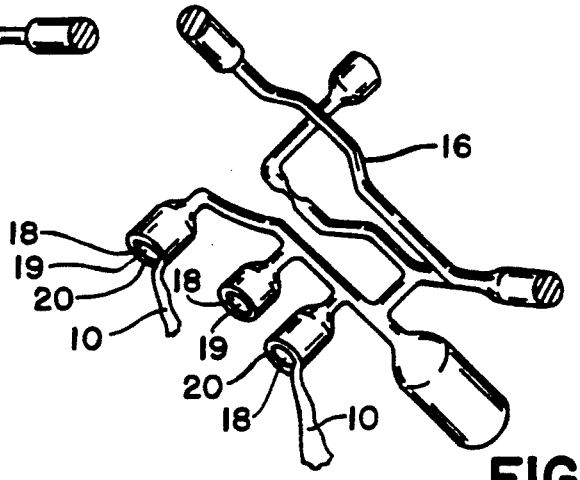
FIG. 4 is an illustration of the removal of the low melting point metal pattern from the metal coating or liner core.
Figure 5:
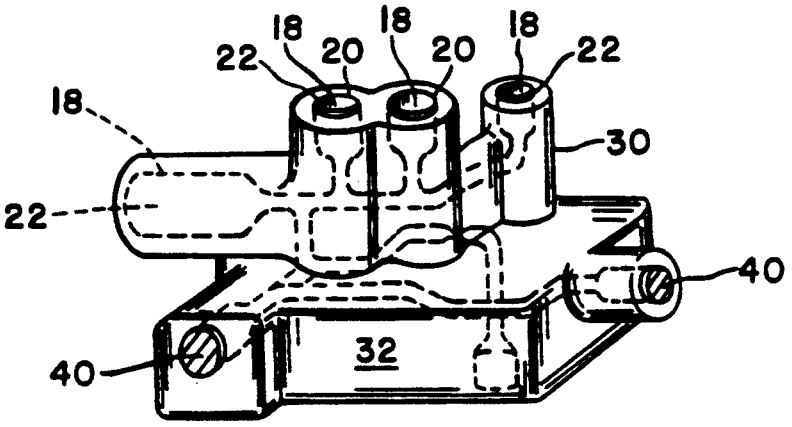
FIG. 5 is an illustration of a finished casting with the liner core.
Figure 6:
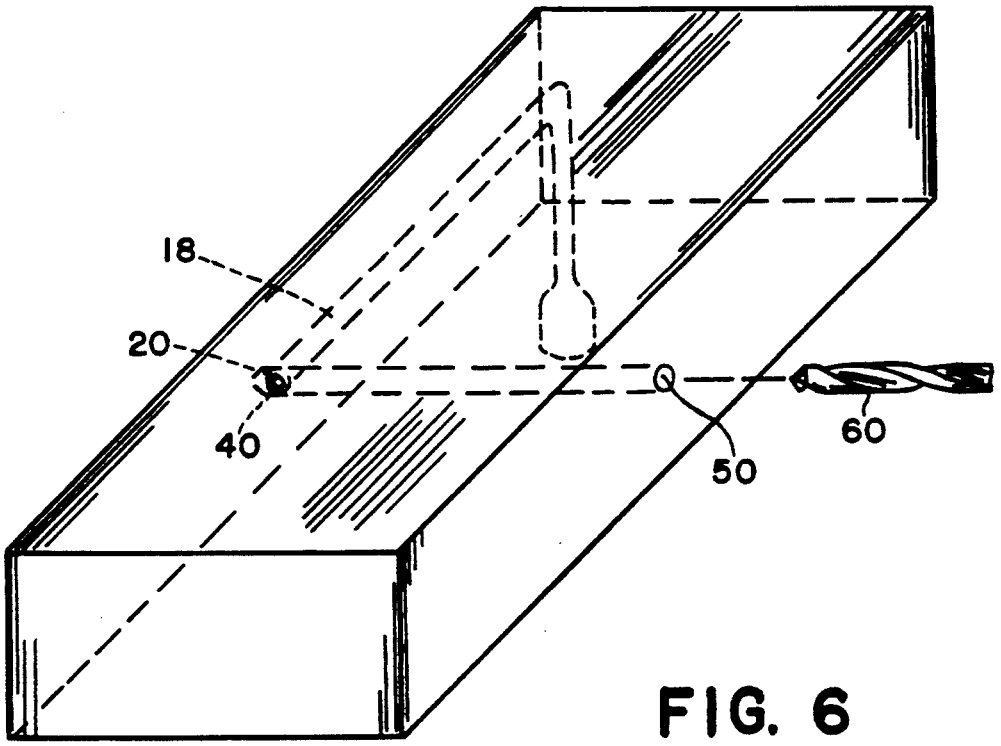
FIG. 6 is an illustration of a form containing therein a liner core with a plugged end opening wherein the form is drilled to create a passage communicating with the end opening and passageway of the liner core.

The present invention provides a method for producing small diameter, smooth, complicated passageways using a high volume casting process. The process can be utilized to produce innumerable items of manufacture, one of which may be a modulator/manifold housing for an anti-lock braking system. An anti-lock brake modulator typically comprises a metal body having therein a plurality of openings which receive solenoid valves that control the flow of hydraulic brake fluid through the modulator body. It is necessary that there be a plurality of very intricate and complex passages within the modulator body in order for the hydraulic brake fluid to be properly modulated during adaptive braking system operation. This has typically required a metal body to have many openings drilled within the body so that selected openings communicate with other openings, and then many of the openings plugged where they terminate at a surface of the metal body. Additionally, many times the drilled opening must be disposed at the side or adjacent a larger opening containing a component such as the solenoid valve. The drilled opening must be placed at the side of the larger opening and communicate with the larger opening via another passageway because if the drilled opening were extended in the modulator it would communicate with another opening with which it should not communciate. It is highly desirable for an anti-lock modulator body to be formed with minimal drilling and machining, and for the hydraulic pathways to be shortened which will result in better hydraulic communication. The present invention provides a process for producing, in high volume, intricate interconnecting smooth, clean passageways inside a castable metal, and which requires virtually no subsequent cleaning or treatment. First, a core shape or pattern is cast or molded of a low melting point metal in order to provide a rigid metal core pattern 10 illustrated in FIG. 1. The formation of the rigid metal core pattern utilizes typical, standard casting techniques readily available for low melting point metals. Because the passageways to be subsequently formed should have a smooth, clean surface, and the surface so formed will be effected by outer surface 12 of the pattern, it is important that pattern 10 also have a smooth outer surface in order to create the smooth inner surface of a liner core. A material called Cerrocast® alloy provided by Cerro Metal Products, Bellefonte, Pa. has shown to be able to provide a smooth outer surface suitable for the present invention. Cerrocast® also has a high electrical conductivity which further facilitates the subsequent plating process. Cerrocast® is made of 40% bismuth and 60% tin. The next step of the process is to coat pattern 10 with nickel using either electroplating or an electroless nickel plating process. FIG. 2 illustrates pattern 10 being immersed within a plating bath in order to effect the coating. Because the low melting point metal alloy comprising Cerrocast® has a high electrical conductivity, the plating of nickel as a coating on pattern 10 is facilitated. FIG. 3 illustrates the nickel coated core pattern 10 wherein uncoated portions 14 extend from nickel plating or liner core 16. As illustrated in FIG. 4, metal pattern 10 which is disposed within nickel plating 16 is then heated to melt the low melting point metal alloy so that it is removed from the interior of the nickel plating or liner core 16. Liner core 16 is made of nickel which was previously coated on pattern 10, with inner surfaces 19 of liner core 16 being smooth. Nickel plating or liner core 16 is then placed in a mold or die cavity (not shown). End openings 20 of liner core 16 may be selectively plugged in order to prevent molten metal or semi-solid formable material from entering into passageways 18 of liner core 16. It should be clearly understood that an end opening 20 of liner core 16 may terminate at or outside of the subsequently formed metal body, or may terminate within the interior of the metal body. In any event, plugs 40 placed in end openings 20 will prevent the molten metal or semi-solid formable material from entering into passageways 18. Alternatively, a portion or passageway of liner core 16 which terminates within the metal body may be closed off so that molten metal or semi-solid formable material does not enter therein. The closing is accomplished by placing that terminus of the portion or passageway within the plating bath (FIG. 2) so that the terminus is plated over and provides a completely plated over terminus after the metal alloy liner core is heated and removed. Once liner core 16 has been placed in a cavity and positioned by epoxy adhesive or other mounting methods (not shown), the molten material comprising the molten metal, or the semi-solid material comprising the formable material, is placed within the cavity in order to form a casted or semi-solid form. Finally, casting or semi-solid form 30 (FIG. 5) is removed from the die or mold, and the plugs are removed from end openings 20 in order to make passageways 18 accessible. The resulting casting or semi-solid form 30 comprises form body 32 having therein a plurality of passageways 18 each defined and surrounded by nickel liner surface 22 which provides a corrosion resistent, porous free liner about each of the passageways. If a passageway 18 should terminate in an end opening closed by plug 40 within body 32 as illustrated in FIG. 6, a drill can be utilized to make a drilled passage or opening 50 which will extend to and communicate with passageway 18. Drill 60 will drill out plug 40 so that when the drilling or machining process is finished, passage 50 will communicate with end opening 20 and passageway 18. Likewise, this drilling procedure can be used to provide a drilled passage that communicates with a previously plated over terminus.

The present invention provides significant advantages over prior methods for providing intricate small passageways within a casting or semi-solid forms. The utilization of a low melting point metal such as Cerrocast® for the pattern material provides a pattern that has strength, is easily electroplated or coated, is easily removed after plating, and is reuseable/recycleable. The utilization of nickel for coating the pattern provides a passageway surface which has strength, stability during casting of the main body, and excellent corrosion resistence. The process also provides passageways or openings which are near net shape which lowers the finished casting weight. In other words, once the body has been cast or formed about the liner core, there is minimal machining required for finishing the product and less cast material is used. As a result of the reduction in machining, there is less utilization of and less wastage of the metal or material utilized to form body 32. Typically, body 32 may be made of a metal such as aluminum; the present process assists in minimizing the use of and creation of aluminum scrap through drilling and machining. As described above, prior methods often have to utilize the drilling of holes next to or adjacent a larger cavity with which the drilled hole would communicate, so that the drilled hole does not communicate undesirably with another opening within the body. Here, the passageways formed may proceed directly from one opening to another opening, be within close proximity to one another, and have very complex patterns, all which would have been extremely difficult to provide by prior processes. This in effect shortens the hydraulic path from one opening in the body to another opening, therefore making the transmission of a hydraulic fluid and pressures more efficient within the modulator body.

The present invention provides a method for producing complex cavities inside castings or semi-solid forms which has numerous applications within industry. For example, the present invention may be utilized for casting the main modulator housing for an anti-lock braking system, or an automatic transmission housing. Also, power steering housings may be formed, hydraulic spool valves for automotive heavy equipment and aerospace applications can be provided, and constant speed drive housing may be formed and utilized in aerospace electric power generation. Further, the process may be utilized to form oil passageways in automotive engines and cylinder heads, to provide jet fuel pump housings for aerospace applications, and to provide lubrication and scavage pump housings. Also, in the aerospace field the present invention may be utilized to provide auxiliary power unit housings. The invention may be utilized widely within many industrial fields wherein there is a demand for quality castings having complicated internal passageways and for castings which require complicated internal passageways with smooth surfaces.

We claim:

1. A process for producing a form having smooth, clean passageways inside the form, comprising the steps of;

a. forming a core pattern from a low melting point material in order to provide a rigid core pattern, b. coating the pattern with nickel, so that the pattern is located interiorly of the nickel and low melting point pattern material is not located about the exterior of the nickel, c. heating the pattern to melt the pattern away from the nickel coating in order to provide only a nickel liner core defining passageways therein, d. placing only the nickel liner core within a preexisting cavity, e. introducing a molten metal material within said cavity and about said liner core in order to provide said form, and f. removing the form from said cavity whereby the liner core comprises a corrosion resistant liner about said passageways within said form.

2. The process in accordance with claim 1, further comprising the step of coating said nickel on said pattern by one of electroplating and electroless nickel plating.

3. The process in accordance with claim 1, further comprising the step of placing selectively plugs within end openings of said liner core so that the molten metal material will not enter into the end openings and associated passageways.

4. The process in accordance with claim 3, further comprising the step of drilling a passage within said form so that said passage passes through a plug such that the plug is drilled out of the form and the passage communicates with the end opening previously closed by said plug.

5. The process in accordance with claim 1, wherein said low melting point material is a metal comprising 40% bismuth and 60% tin.

6. The process in accordance with claim 1, wherein said low melting point material comprises a material having a high electrical conductivity.

7. The process in accordance with claim 1, wherein the low melting point material provides smooth, porous free surfaces on the core pattern.

8. A process for producing a form having smooth, clean passageways inside the form, comprising the steps of;

a. forming a core pattern from a low melting point material in order to provide a rigid core pattern, b. coating the pattern with nickel, so that the pattern is located interiorly of the nickel and low melting point pattern material is not located about the exterior of the nickel, and including coating over a passage terminus of the pattern to provide a plated over passage terminus within the form, c. heating the pattern to melt the pattern away from the nickel coating in order to provide only a nickel liner core defining passageways therein, d. placing only the nickel liner core within a preexisting cavity, e. introducing a molten metal material within said cavity and about said liner core in order to provide said form, and f. removing the form from said cavity whereby the liner core comprises a corrosion resistant liner about said passageways within the form and including the plated over passage terminus within the form.

9. The process in accordance with claim 8, further comprising the step of drilling a passage in said form so that the drilled passage intersects said plated over passage terminus.

* * * * *